US005875503A

United States Patent [19]

Cheldin

[11] Patent Number: 5,875,503

[45] Date of Patent: Mar. 2, 1999

[54] COMBINATION STAPLE REMOVER AND LETTER OPENER

[75] Inventor: Erwin Cheldin, Woodland Hills, Calif.

[73] Assignee: Erkie, Inc., Las Vegas, Nev.

[21] Appl. No.: 912,884

[22] Filed: Aug. 15, 1997

[51] Int. Cl.[6] ..... B26B 11/00

[52] U.S. Cl. ..... 7/160; 7/166; 254/28

[58] Field of Search ..... 7/158, 160, 166; 254/28

[56] References Cited

U.S. PATENT DOCUMENTS 4,670,926 6/1987 Bruno ..... 7/160

5,354,033 10/1994 Cheldin ..... 7/160 X

*Primary Examiner*—James G. Smith

*Attorney, Agent, or Firm*—Bernard R. Gans; Jeffer, Mangels, Butler & Marmaro LLP

[57] ABSTRACT

A staple remover is provided with first and second jaws pivotally connected for rotation about a single axis having wedging elements for prying a staple away from a stapled article. The remover may include gripping elements for grasping a partially disengaged or sheared staple. A letter opening is provided on one of the jaws for insertion into an envelope and slitting the same for opening the envelope.

11 Claims, 1 Drawing Sheet

COMBINATION STAPLE REMOVER AND LETTER OPENER

BACKGROUND OF THE INVENTION

1. Field of the Invention

The invention relates to staple removers; and, more particularly, to double jawed staple removers.

2. Description of the Related Art

A wide variety of modern-day businesses utilize staple removers on a daily basis to effect disengagement of staples from stapled articles. Staple removers are also commonly used within the personal residence of the typical consumer. Of the commercially available hand-held staple removers utilized in both business and consumer applications, one of the most common types is the double-jawed staple remover.

The typical double-jawed staple remover is provided with first and second jaws which are pivotably connected for rotation towards one another about a single axis. The first jaw has a first pair of spaced apart walls which move in a plane which is perpendicular to the axis of rotation and which have wedging elements for engaging a staple. The second jaw has a second pair of spaced apart walls which also move in a plane which is perpendicular to the axis of rotation and which also have wedging elements for engaging a staple. The distance between the second pair of walls relative to the first pair of walls is such that, upon rotation of the first and second jaws towards one another into a closed position, the second pair of walls are positioned between the overlap with the first pair of walls.

The first and second jaws of these staple removers are typically provided with finger receiving elements which are positioned on the outside of the first and second jaws, respectively, substantially adjacent the wedging elements of the first and second pairs of walls.

To effect removal of a staple from a stapled article, the operator forcibly rotates the first and second jaws towards one another into overlapping positions, usually by applying a thumb to one finger receiving element and one or more fingers to the other finger receiving element, simultaneously driving the wedging elements of the first and second pair of walls between the staple and the stapled article and thereafter pulling or twisting the double-jawed staple remover so as to disengage the staple from the stapled article.

In my U.S. Pat. No. 5,354,033, I addressed the problem where, in heavy duty applications, the operator must often apply substantial forces to the finger receiving elements and may succeed only in partially disengaging the staple from the stapled article. In the course of squeezing, pulling and/or twisting the staple, it is also common for the staple to shear so as to leave a portion of the staple within the stapled article with an exposed tip extending therefrom. Accordingly, the operator of these double-jawed staple removers must locate a pair of pliers or other suitable means for gripping and separating the partially disengaged or sheared staple from the stapled article. This is highly inefficient and results in the loss of valuable time. I thus disclosed in my patent a double-jawed staple-remover having a pair of grippers for removing partially disengaged or sheared staples from a stapled article.

Thus, the staple remover in my U.S. Pat. No. 5,354,033 is a multi-purpose tool. It is desirable to have such a tool perform as many functions as possible. For example, the staples being removed may be attached to letters or other correspondence arriving at the user's desk in envelopes. There is thus a need for an envelope opening tool handy along with the staple remover.

Thus, it is desirable to provide a staple remover with an envelope opening tool on the remover itself.

SUMMARY OF THE INVENTION

It is an object of this invention to provide a staple remover having pivotable jaws with a letter opener integral with one of the jaws.

It is a further object of this invention to provide such a staple remover having built-in gripping elements for gripping a staple to remove the same.

These and other objects are preferably accomplished by providing a staple remover with first and second jaws pivotally connected for rotation about a single axis having wedging elements for prying a staple away from a stapled article. The remover may include gripping elements for grasping a partially disengaged or sheared staple. A letter opener is provided on one of the jaws for opening letters.

DESCRIPTION OF THE PREFERRED EMBODIMENT

Figure 1:
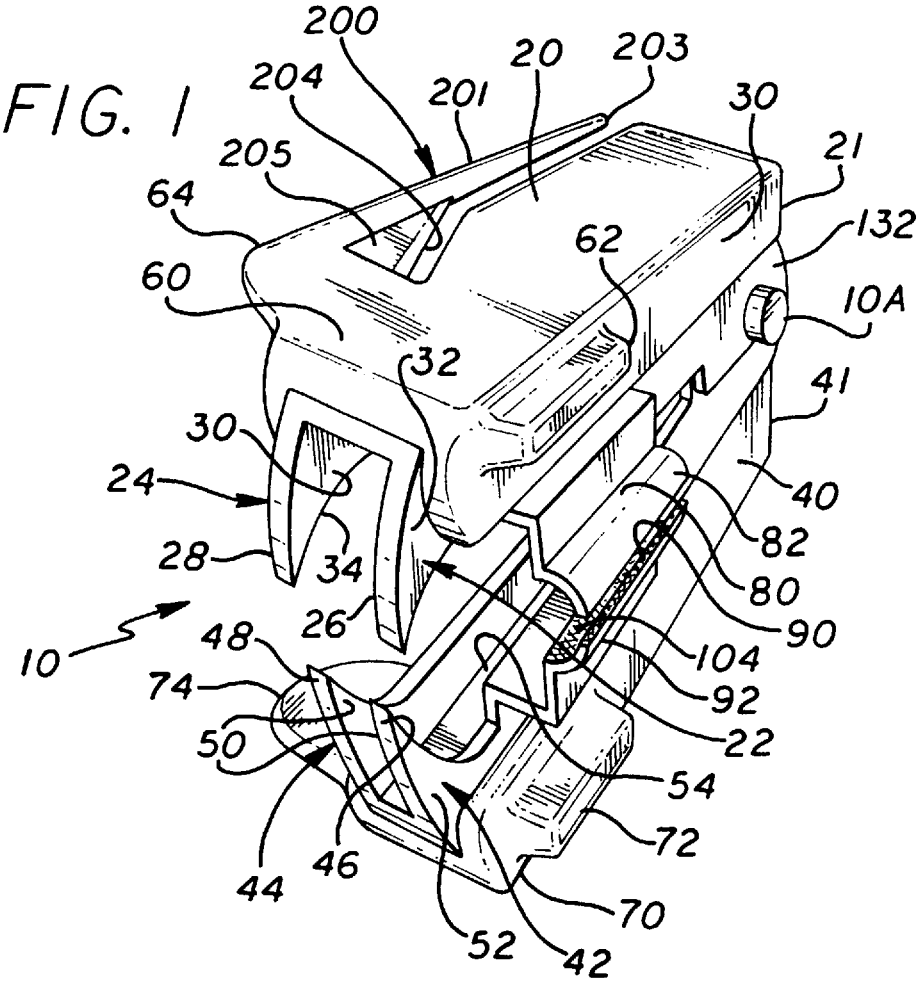
FIG. 1 is a perspective view of a staple remover in accordance with the teachings of the invention.

Referring now to FIG. 1 of the drawing, a double-jawed staple remover 10 is shown having first and second jaws 20, 40 pivotally connected at ends 21, 41, respectively, for rotation toward one another about a single axis 10A. Axis 10A includes a pin 100 (seen in dotted lines in FIG. 2) extending through aligned apertures in ends 21 and 41 terminating in enlarged rivets or heads 101, 102 as is well known in the staple remover art. A spring 103, encircling pin 100, is used to bias jaws 20 and 40 away from one another into the open position shown in FIG. 1 also as is well known in the art.

The first jaw 20 has a pair of spaced apart walls 22 and 24 which move in a plane perpendicular to the axis of rotation 10A and which have opposed wedging elements 26 and 28.

Walls 22 and 24 each have an inner face 30, an outer face 32, and an edge 34. The second jaw 40 has a pair of spaced apart walls 42 and 44 which also move in a plane perpendicular to the axis of rotation 10A and which have wedging elements 46 and 48 at the thereof. Walls 42 and 44 include inner faces 50, outer faces 52, and edges 54.

The distance between the second pair of walls 42 and 44 relative to the first pair of walls 22 and 24 is preferably such that, upon rotation of the first and second jaws towards one another, the inner faces 30 of wall 22 and 24 slidably engage the corresponding outer faces 52 of walls 42 and 44, with walls 42 and 44 being positioned between and overlapping with walls 22 and 24 when the improved staple remover 10 is in a closed position (not shown).

A first finger receiving element 60 is provided on the first jaw 20 to facilitate manual rotation of the first jaw 20 into slidable engagement with the second jaw 40. Similarly, a second finger receiving element 70 is provided on the second jaw 40 to facilitate manual rotation of the second jaw 40 into slidable engagement with the first jaw 40.

The first finger receiving element 60 includes a first pair of finger tabs 62 and 64 which extend away from the first jaw 20 in opposing directions which are substantially parallel to the axis of rotation 10A. Similarly, the second finger receiving element 70 includes a second pair of finger tabs 72 and 74 which extend away from the second jaw 40 in opposing directions which are substantially parallel to the axis of rotation 10A.

The first and second jaws 20 and 40 are also provided with an opposing pair of gripping elements 80 and 90 which cooperate to engage and detach difficult-to-remove staples from stapled articles.

Gripping element 80 is provided extending from the outer face 132 of jaw 20, extending away from the first jaw 20 in a direction substantially parallel to the axis of rotation 10A. The opposing gripping element 90 is similarly positioned on wall 42.

The first and second gripping elements 80 and 90 include primary gripping surfaces 82 and 92, respectively. The primary gripping surfaces 82 and 92, respectively. The primary gripping surfaces 82 and 92 are configured for substantially complemental engagement.

These surfaces may be provided with serrations, such as serrations 104, for increased gripping, as shown (similar serrations—not shown—are provided on the underside of element 80).

To effect removal of a partially disengaged staple or a sheared staple from a stapled article, the operator needs only to rotate the improved staple remover 10 within his or her hand 90 degrees from the normal position of use and then, using a thumb applied to one finger receiving element and one or more fingers applied to the other finger receiving element, squeezing the primary gripping surfaces 82 and 92 into simultaneous engagement with the subject staple and thereafter pulling or twisting the double-jawed staple remover so as to completely disengage the partially disengaged or sheared staple from the stapled article.

The primary gripping surfaces 82 and 92 extend beyond the ends of finger tabs 62 and 72 sufficiently to ensure proper engagement with a partially disengaged or sheared staple without interference from finger tabs 62 and 72. The primary gripping surfaces 82 and 92 are provided with discontinuities in the form of serrations 104 to improve the gripping characteristics thereof.

Those skilled in the art will understand that the finger tabs are not part of any present invention and may be excluded or reduced in size where desired. It will also be understood by those skilled in the art that the gripping elements 80 and 90 may be positioned anywhere on the first and second jaws 20 and 40, respectively, so long as the gripping elements 80 and 90 cooperate to grasp a partially disengaged or sheared staple.

The gripping elements 80, 90 are configured so as to define a small cavity therebetween when the first and second jaws 20 and 40 are in the closed position (not shown) for gripping objects having a thickness which is greater than distance between the first and second secondary gripping surfaces.

For most applications, it is preferred that jaws 20 and 40 and gripping elements 80 and 90, be composed of a rigid durable oxidation-resistant material such as stainless steel. Those skilled in the art will also understand that gripping elements 80 and 90 may be integrally formed with jaws 20 and 40 or, alternatively, may be attached thereto using conventional means.

The finger receiving elements 60 and 70 may also be integrally formed with first and second jaws 20 and 40, respectively. However, it is preferred that the finger receiving elements 60 and 70 be composed of a hard plastic or other low cost material suitable for the application.

Figure 2:
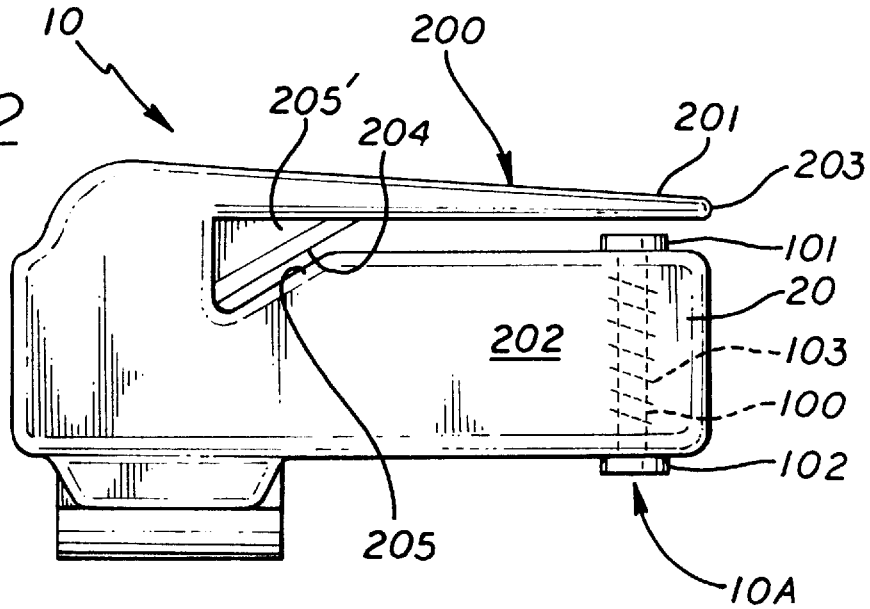
FIG. 2 is a top plan view of the staple remover of FIG. 1.

As particularly contemplated in the present invention, letter opening means 200 are provided on first jaw 20 in the form of an elongated finger or insertion element 201 spaced from the main body portion 202 of jaw 20 as seen in FIG. 2. Also as seen in FIG. 2, element 201 may taper from the front to the rear thereof and is relatively thin in thickness so that the narrower terminal end 203 may be inserted between the sealed flap and main body portion of an envelope. A sharp cutting element 204 is also provided rearwardly of end 203 in the form of a triangularly shaped blade 205' mounted on finger 201 extending into a like configured cut out portion 205 of the main body portion 202 of jaw 20. In operation, end 203 of insertion element 201 is slid between the flap and main body portion of an envelope and blade 205' of cutting element 204 cuts open the flap. If the envelope contains a stapled letter or the like, the device 10 can be used to remove such staples as heretofore discussed.

Having thus described the foregoing exemplary embodiments of the present invention, it should be noted by those skilled in the art that the disclosures within are exemplary only and that various other alternatives, adaptations, and modifications may be made within the scope and spirit of the present invention. Accordingly, the scope of the present invention is not limited to the specific embodiments as illustrated herein, but is only limited by the following claims and equivalents thereof. Further, unless a claim element contains the words "means for," the applicant is not intending to claim the benefits 35 U.S.C. 112(b).

I claim:

1. A staple remover having first and second jaws which are pivotably connected for rotation about a single axis and having first and second elements which can cooperate to pry a staple away from a stapled article wherein the improvement comprises:

an insertion member having a cutting element thereon disposed on one of said jaws adapted to slit open an envelope when inserted under a sealed flap portion of an envelope;

wherein said insertion member is an elongated finger on one of said jaws each of said jaws having a main body portion, said finger being spaced from said main body portion of said one said jaws;

and wherein each of said jaws has a front and a rear end, said finger tapering from a first end at said front end of said one of said jaws to a narrow terminal second end spaced from said front end of said one of said jaws.

2. The staple remover of claim 1 wherein said cutting element is a blade associated with said first end of said finger.

3. The staple remover of claim 2 wherein said cutting blade is generally triangularly shaped coupled to said finger extending into a cut-out portion on said main body portion of said one of said jaws.

4. A combination staple remover and letter opener comprising: first and second jaws which are pivotably connected for rotation about an axis;

wherein each of said first and second jaws has a front end and a rear end;

and wherein each of said jaws has a main body portion; a first wedging element connected to said first jaw and a second wedging element connected to said second jaw which can cooperate to pry a staple away from a stapled article;

wherein said wedging elements are connected to said front end of said jaws;

and a letter opener disposed on one of said jaws adapted to slit open an envelope when inserted under a sealed flap portion of said envelope;

wherein said letter opener includes an insertion member on one of said jaws, said insertion member being spaced from said main body portion of said one of said jaws;

said insertion member tapering from a first end at said front end of said one of said jaws to a narrow terminal second end spaced from said front end of said one of said jaws.

5. The combination of claim 4 wherein said letter opener includes a cutting element associated with said first end of said insertion member.

6. The combination of claim 5 wherein said cutting element is a generally triangularly shaped blade coupled to said insertion member extending into a cut-out portion on said main body portion of said one of said jaws.

7. The combination of claim 4 wherein said first jaw has a generally flat upper surface lying in a plane said letter opener lying in generally the same plane as said flat upper surface whereby said insertion member can be used to slit open an envelope and said wedging elements can be used to remove a staple.

8. The combination of claim 4 including a first gripping element connected to and extending laterally from said first jaw and a second gripping element connected to and extending laterally from said second jaw, such that, upon rotation of said first and second jaws toward one another, said gripping elements can be used to grasp an object as small as a partially removed staple.

9. A staple remover having first and second jaws which are pivotably connected for rotation about a single axis, each jaw having a front and a rear end, and having first and second elements which can cooperate to pry a staple away from a stapled article and a first gripping element connected to and extending laterally from said first jaw and a second gripping element connected to and extending laterally from said second jaw such that, upon rotation of said first and second jaws toward one another, said gripping elements can be used to grasp an object as small as a partially removed staple, the improvement which comprises:

letter opening means disposed on one of said jaws adapted to slit open an envelope when inserted under a flap portion of said envelope;

wherein said letter opening means includes an elongated finger on one of said jaws, each of said jaws having a main body portion, said finger being spaced from said main body portion of said one of said jaws;

said finger tapering from a first end at said front end of said one of said jaws to a narrow terminal second end spaced from said front end of said one of said jaws.

10. The staple remover of claim 9 wherein said letter opening means includes a cutting blade associated with said first end of said finger.

11. The staple remover of claim 10 wherein said cutting blade is generally triangularly shaped coupled to said finger extending into a cut-out portion on said main body portion of said one of said jaws.

* * * * *